US005604324A

United States Patent [19]

Kubota et al.

[11] Patent Number: 5,604,324

[45] Date of Patent: Feb. 18, 1997

[54] MUSICAL TONE SIGNAL GENERATING APPARATUS INCLUDING A PLURALITY OF VOICE UNITS

[75] Inventors: Itsuro Kubota; Yasuyuki Umeyama, both of Hamamatsu, Japan

[73] Assignee: Yamaha Corporation, Japan

[21] Appl. No.: 363,714

[22] Filed: Dec. 23, 1994

[30] Foreign Application Priority Data

Dec. 27, 1993 [JP] Japan ..... 5-332343

[51] Int. Cl.[6] ..... G10H 1/06; G10H 7/00

[52] U.S. Cl. ..... 84/622

[58] Field of Search ..... 84/601–607, 622–625, 84/345, 370, 645, 659–661

[56] References Cited

U.S. PATENT DOCUMENTS

| | | | |
|---|---|---|---|
| Re. 31,004 | 8/1982 | Niimi | 84/661 |
| 4,244,264 | 1/1981 | Fellot | 84/345 |
| 5,020,410 | 6/1991 | Sasaki | 84/602 |
| 5,200,564 | 4/1993 | Usami et al. | 84/602 |
| 5,321,198 | 6/1994 | Suzuki et al. | 84/605 |
| 5,371,319 | 12/1994 | Sato | 84/622 |

*Primary Examiner*—Stanley J. Witkowski
*Attorney, Agent, or Firm*—Graham & James LLP

[57] ABSTRACT

A musical tone signal generating apparatus having a plurality of voice units connected to a common data bus to which a master central processing unit or master CPU, a program read-only memory or program ROM and a random access memory or RAM are connected, wherein a control program and a control data for synthesis of plural element musical tone signals are applied to the voice units from the common data bus through a bus controller under control of the master CPU, wherein the voice units each include a slave central processing unit or slave CPU, a slave random access memory or slave RAM, a digital signal processor or DSP and a random access memory or RAM for the DSP for executing the control program for synthesis of the element musical tone signals defined by the control data.

5 Claims, 14 Drawing Sheets

MUSICAL TONE SIGNAL GENERATING APPARATUS INCLUDING A PLURALITY OF VOICE UNITS

BACKGROUND OF THE INVENTION

1. Field of the Invention

The present invention relates to a musical tone signal generating apparatus for generating synthesized musical tone signals, and more particularly to a musical tone signal generating apparatus provided with a plurality of voice units for independently synthesizing musical tone signals applied thereto.

2. Description of the Prior Art

Disclosed in Japanese Utility Model Publication No. 62-20878 is a musical tone signal generating apparatus of the type which includes a plurality of voice units connected to a common data bus to synthesize musical tone signals of different fixed tone colors. In the musical tone generating apparatus, the voice units are applied with a selection data together with a tone pitch data and a tone volume data from the common data bus to synthesize the musical tone signals of fixed tone colors in a condition where the tone color of the synthesized musical tone signal is identical with a tone color defined by the selection data.

In such a conventional musical tone signal generating apparatus as described, an additional voice unit of a fixed tone color can be connected to the common data bus to produce musical tone signals of various tone colors. However, each tone color of the musical tone signals produced by the voice units is fixed. For this reason, it is required to provide various kinds of voice units for producing musical tone signals of various tone colors.

SUMMARY OF THE INVENTION

It is, therefore, a primary object of the present invention to provide a musical tone signal generating apparatus wherein a plurality of common voice units are connected to a common data bus to produce musical tone signals of various tone colors.

According to the present invention, the object is accomplished by providing a musical tone signal generating apparatus having a primary processing portion connected to a common data bus for applying a control program and a control data for synthesis of plural element musical tone signals to the common data, which musical tone signal generating apparatus comprises a plurality of common voice units connected to the common data bus, the voice units each including ancillary memory means for memorizing the control program and control data applied from the common data bus and ancillary processing means for executing the control program for synthesis of the element musical tone signals defined by the control data; and data transmission means for transmitting the control program and control data to the ancillary memory means of each of the voice units from the common data bus under control of the primary processing portion.

According to an aspect of the present invention, the primary processing portion includes an operation element for selecting a tone color of a musical tone to be generated, memory means for memorizing a plurality of voice parameters for synthesis of the element musical tone signals and means for checking the voice parameter corresponding with the selected tone color and for applying the checked voice parameter to the common data bus, and the data transmission means includes means for selectively transmitting the checked voice parameter and the control program and control data to the ancillary memory means of each of the voice units in accordance with the selected tone color.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
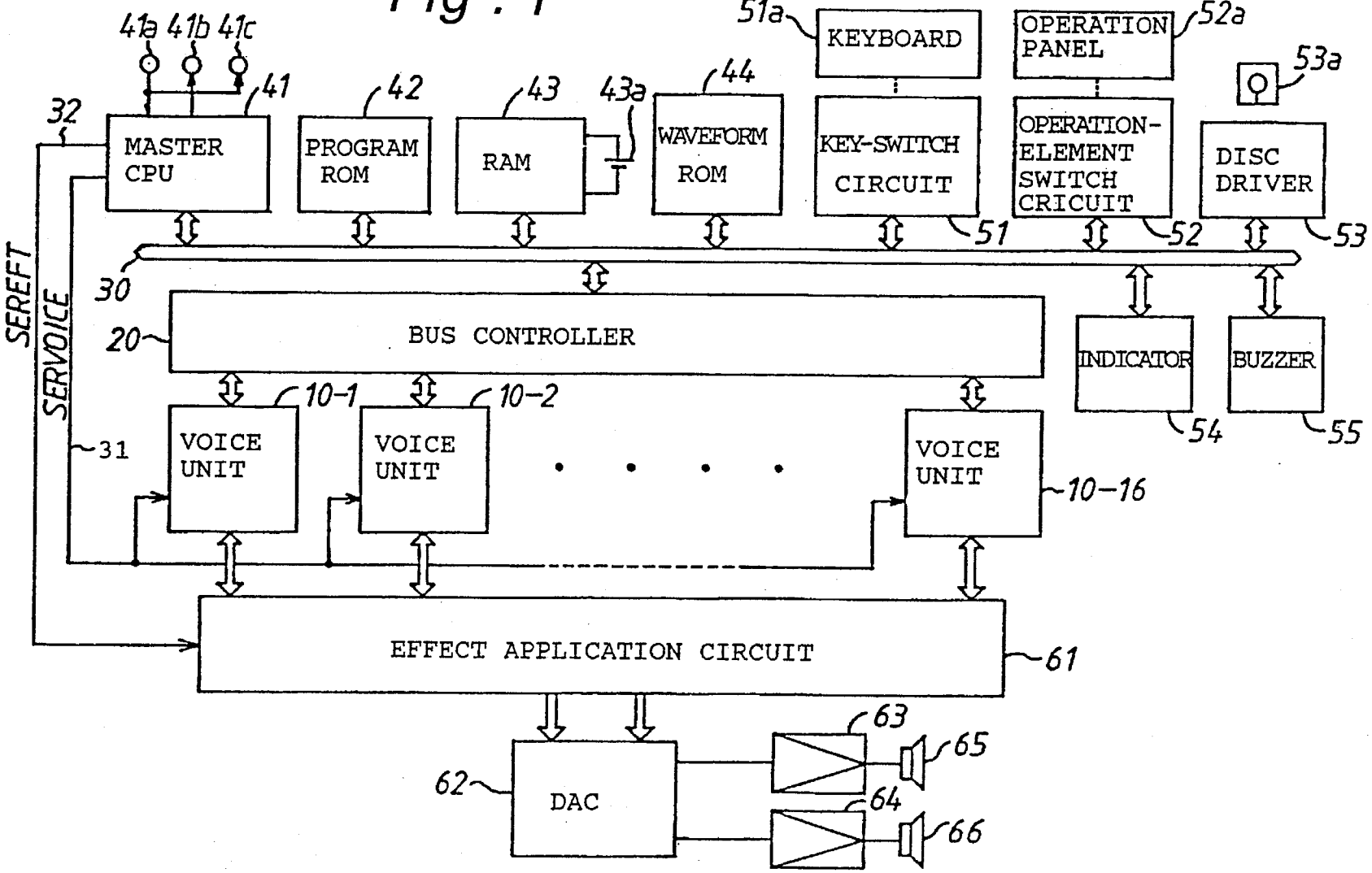
FIG. 1 is a block diagram of a preferred embodiment of an electronic musical instrument equipped with a musical tone signal generating apparatus in accordance with the present invention.

In FIG. 1 of the drawings, there is schematically illustrated a preferred embodiment of an electronic musical instrument of the keyboard type equipped with a musical tone signal generating apparatus in accordance with the present invention. The musical tone signal generating apparatus includes sixteen voice units 10-1 to 10-16 each arranged to execute a control program for synthesis of musical tone signals defined by a control data and for generating synthesized musical tone signals therefrom. The voice units 10-1 to 10-16 are connected to a common data bus 30 through a bus controller 20, and the data bus 30 is connected to a master central processing unit or master CPU 41, a program read-only memory or program ROM 42, a random access memory or RAM 43 and a waveform read-only memory or waveform ROM 44.

Figure 3:
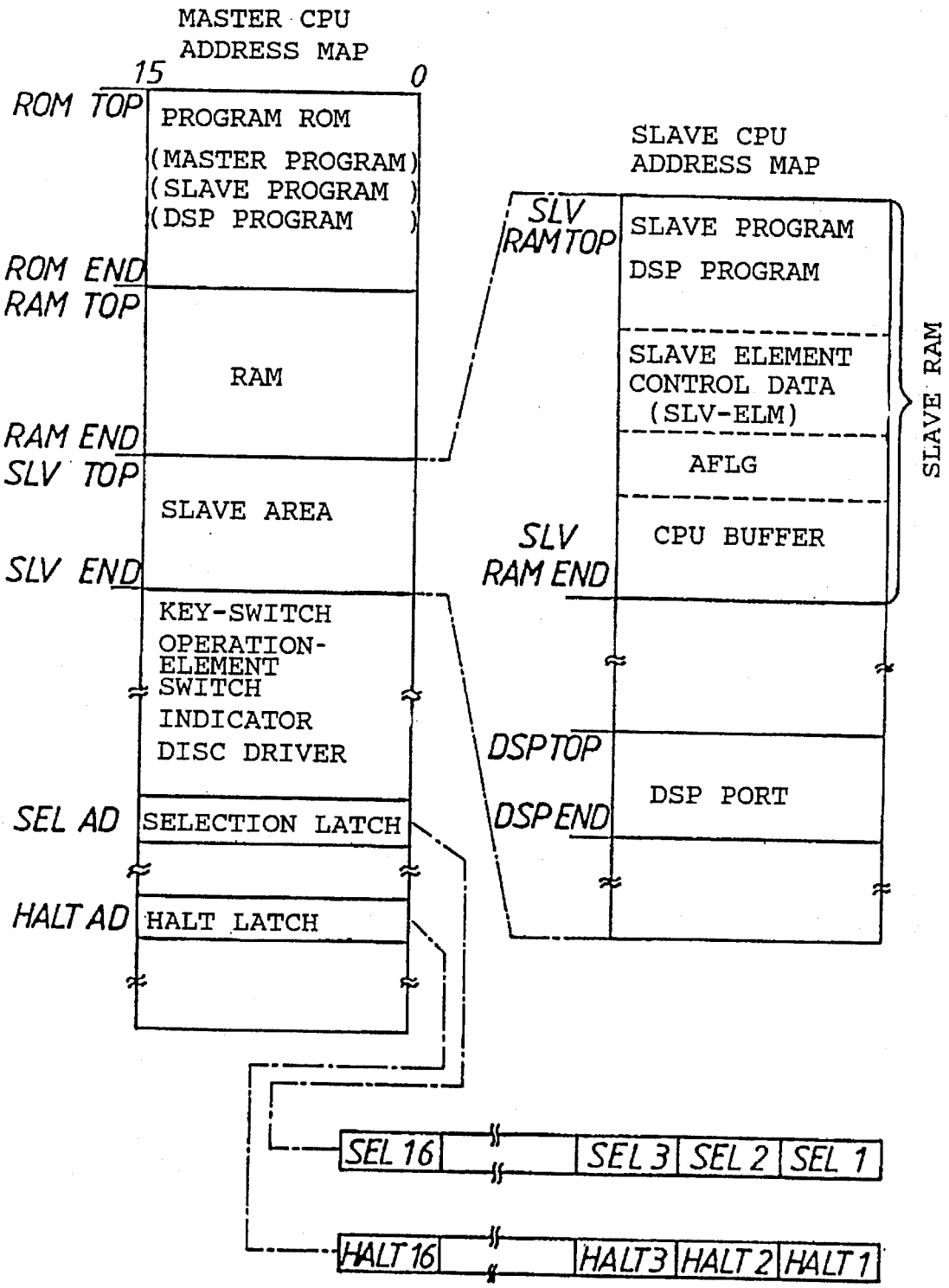
FIG. 3 is an address map for a master CPU and a slave CPU respectively shown in FIGS. 1 and 2.
Figure 4:
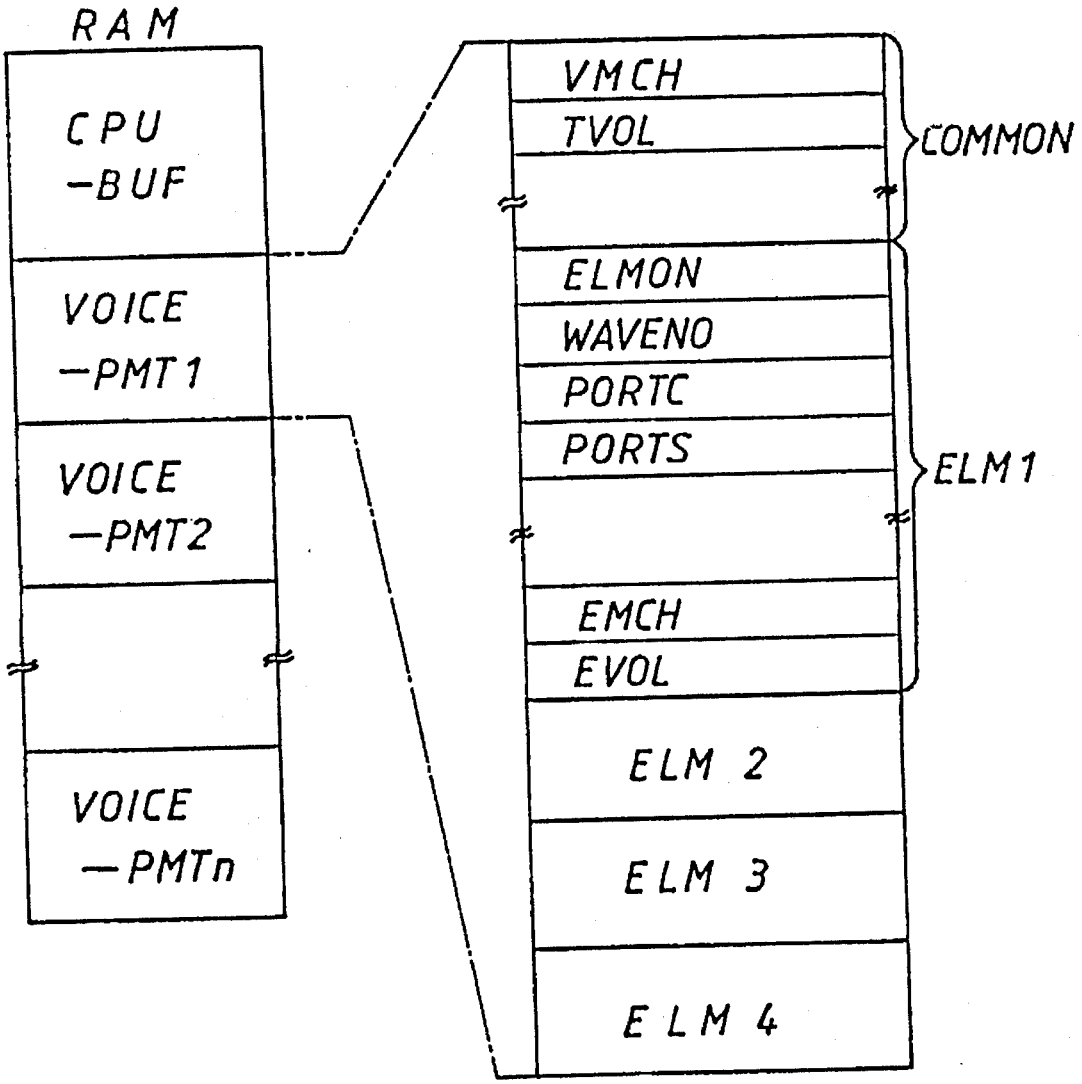
FIG. 4 is a memory map of a random access memory for the master CPU shown in FIG. 1.

The master CPU 41 is designed to execute a master program memorized in the program ROM 42. The master CPU 41 is provided with an input terminal 41*a* to be applied with a musical instrument digital interface data or MIDI data from another electronic musical instrument, an output terminal 41*b* for applying the MIDI data to the other electronic musical instrument and an output terminal 41*c* for applying the MIDI data applied from the other electronic musical instrument to a further electronic musical instrument. The MIDI data is composed of a key-on/off signal, a pitch data, a key-touch data and a channel data. Illustrated in FIG. 3 are address maps of various circuits under control of the master CPU 41. The program ROM 42 is arranged to memorize a master program shown by flow charts in FIGS. 4 to 14, a slave program shown by a flow chart in FIG. 15 and a DSP program for synthesis of the applied musical tone signals. The DSP program is adapted as a microprogram for defining algorithm of an arithmetic logic portion 13*b* for synthesizing musical tone signals at each digital signal processor or DSP 13 in the voice units 10-1 to 10-16. The RAM 43 is backed up by a battery 43*a*. As shown in FIG. 4, the RAM 43 has a buffer area CPU-BUF for memorizing variables necessary for execution of the master program and a plurality of memory areas for memorizing plural pairs of voice parameters VOICE-PMT1-VOICE-PMTn respectively used as a control data for synthesizing the musical tone signals at the respective voice units 10-1 to 10-16.

In this embodiment, a plurality of musical tone signals (four musical tone signals in maximum) are overlapped to be generated as a synthesized musical tone or voice. Hereinafter, each musical tone signal to be synthesized is referred to an element musical tone signal. The voice parameters VOICE-PMTk(k=1–n) each are composed of a common control data COMMON for the element musical tone signal and each control data ELM1-ELM4 for the element musical tone signal. The common control data COMMON includes a voice MIDI-channel data VMCH, a total volume data TVOL and the like. When the input terminal 41*a* of master CPU 41 is applied with the MIDI data including the same channel data as the voice MIDI-channel data VMCH, it is indicated by the voice MIDI-channel data VMCH to synthesize a plurality of musical tone signals corresponding with voice parameters VOICE-PMTk(k=1–n) including the voice MIDI-channel data VMCH. The total volume data TVOL is adapted to define a total volume of the synthesized element musical tone signal. The control data ELM1-ELM4 each includes an element-on data ELMON, a waveform number data WAVENO, a portamento-curve data PORTC, a portamento-speed data PORTS, an element MIDI-channel data EMCH and an element volume data EVOL.

The element-on data ELMON represents element musical tone signals to be synthesized for producing a synthesized musical sound or voice. The waveform number data WAVENO represents a kind of musical tone waveform data memorized in the waveform ROM 44 to be utilized for synthesis of the element musical tone signals. The portamento curve data PORTC and portamento-speed data PORTS designate a pitch variation curve and a pitch variation speed of a portamento-effect applied to the element musical tone signal, respectively. The element MIDI channel data EMCH is adapted to designate synthesis of the element musical tone signals corresponding with the element MIDI channel data EMCH when the input terminal 41*a* is applied with the MIDI data including the same channel data as the element MIDI channel data EMCH. The element volume data EVOL is adapted to define a tone volume of the element musical tone signals.

Figure 5:
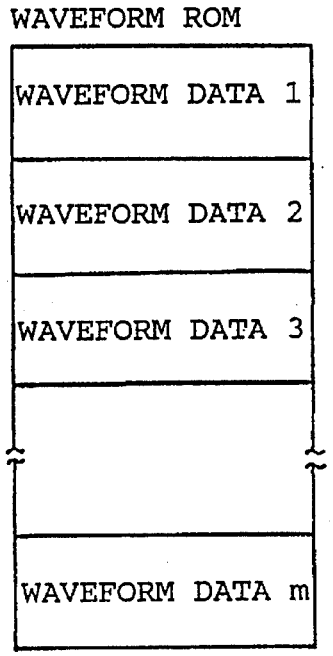
FIG. 5 is a memory map of a waveform ROM shown in FIG. 1.

The waveform ROM 44 is designed to memorize plural pairs of waveform data (1-m) representing musical tone waveforms such as a flute, a violin or the like as shown in FIG. 5. These waveform data are In the form of various forms related to control of the DSP 13 under the DSP program memorized in the program ROM 42. For example, if the control of DSP 13 is effected only to read out the waveform data, the waveform data each are composed of a group of data representing each sampling value of the musical tone waveforms during generation of the musical tone. If the control of DSP 13 is effected to repeatedly read out a sustain part of the waveform data at each time when an attack part of the waveform data is read out and to finally read out a release part of the waveform data, the waveform data each are composed of a group of data each representing the attack part, several periods or scores of periods of the sustain part and each sampling value of the release part.

If the control of DSP 13 is effected to repeatedly read out the waveform data at a period or several periods and to apply an envelope to the read out waveform data with or without periodically changing the same, the waveform data each are composed of a group of data each representing each sampling value of the musical tone waveforms at the period or several periods. If the control of the DSP 13 is effected to synthesize the element musical tone signals by a modulation method such as FM modulation, AM modulation or the like, the waveform data each are composed of a group of data each representing each sampling value of the waveforms utilized for the modulation. If the control of DSP 13 is effected by a filter circuit through which the musical tone waveform is circulated to be varied in accordance with lapse of a time, the waveform data each are composed of a group of data each representing a sampling value of an initial musical tone waveform memorized first in a delay circuit or a memory circuit for circulation of the waveform.

The common data bus 30 is connected to a key-switch circuit 51, an operation-switch circuit 52, a disc driver 53, an indicator 54 and a buzzer 55. The key-switch circuit 51 includes a plurality of keys to be turned on or off in response to depression or release of a plurality of keys on the keyboard 51*a*, the same number of key-switches as the plurality of keys and a detection circuit for detecting on-off operation of the key-switches. The operation-switch circuit 52 includes a plurality of performance operation elements provided on an operation panel 52*a* for selecting or defining a tone color, a tone volume or a sound effect of a musical tone to be generated, a plurality of operation-switches each corresponding with the operation elements for input of the program and control of the disc driver 53 and a detection circuit for detecting on-off operation of the operation-switches. The disc driver 53 is provided to write various data into an external memory medium such as a magnetic disc and to read out the written data from the memory medium. The indicator 54 is provided to indicate a selected condition of the tone color, tone volume and sound effect, an abnormal condition of the voice units 10-1 to 10-16 and various conditions of the electronic musical instrument such as a controlled condition of the disc driver 54. The buzzer 55 is provided to issue an alarm sound therefrom.

Figure 2:
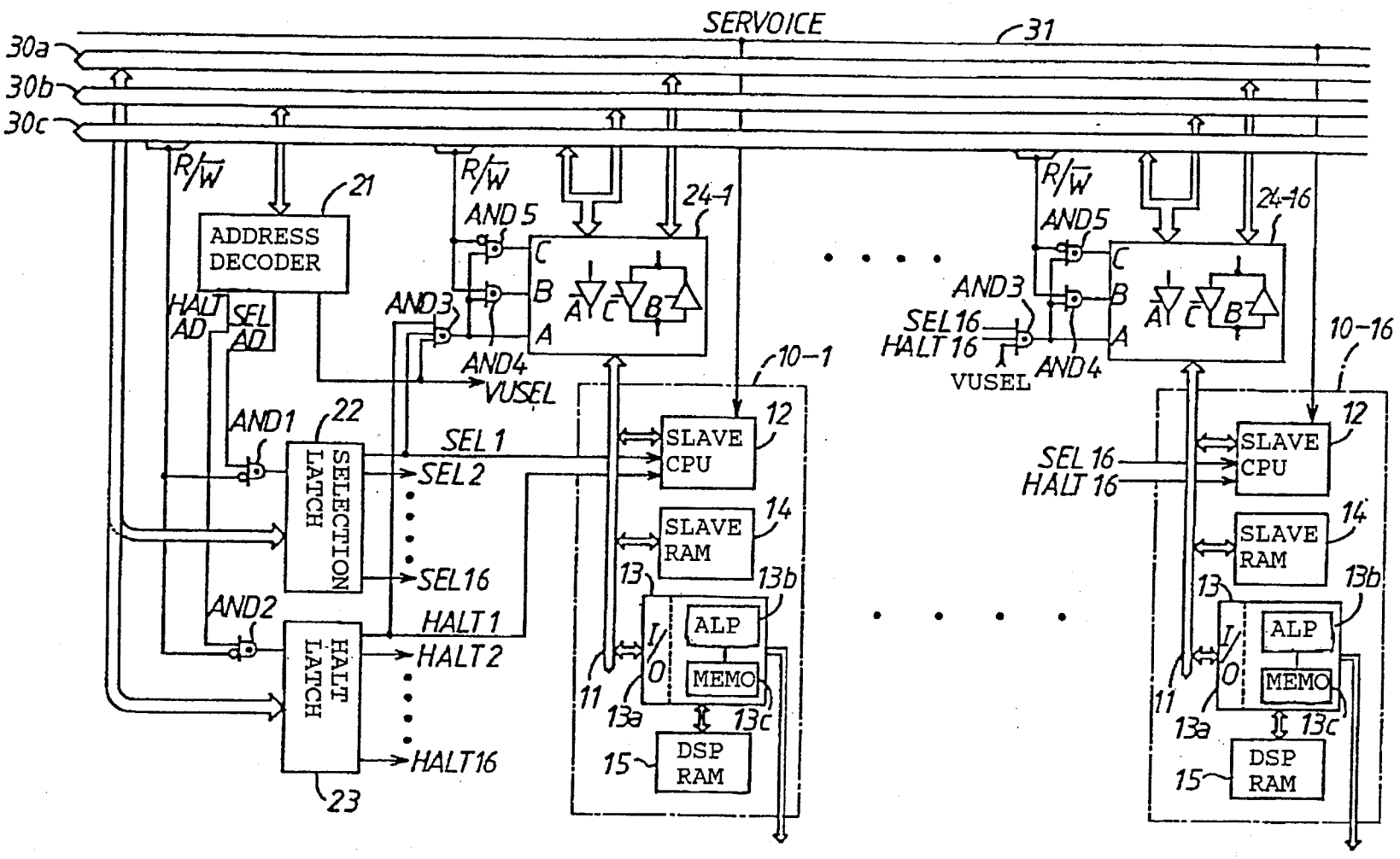
FIG. 2 is a block diagram of a plurality of voice units and a bus controller shown in FIG. 1.

Hereinafter, the voice units 10-1 to 10-16 and the bus controller 20 will be described in detail. As shown in FIG. 2, the voice units 10-1 to 10-16 each includes a slave central processing unit or slave CPU 12 connected to the slave bus 11, a digital signal processor or DSP 13, a slave random access memory or slave RAM 14 and a DSP random access memory or DSP-RAM 15. The slave CPU 12 is arranged to execute a slave program shown by a flow chart in FIG. 15 and to control the DSP 13 for producing a synthesized musical tone signal therefrom. Illustrated in FIG. 3 is an address map under control of the slave CPU 13. The slave CPU 12 is applied with a key-on or key-off signal indicative of a depressed or released key on the keyboard 51*a* and a pitch data indicative of a tone pitch of a depressed key from the master CPU 41 and is directly applied with a serial control data SERVOICE such as a control data (for instance, a pitch-event control data) for control of a musical tone signal produced by operation of the operation panel 52 through a transmission line 31. The slave CPU 12 is further applied with selection signals SEL1-SEL16 for selection of the voice units 10-1 to 10-16 and halt signals HALT1-HALT16 for temporarily halting the execution of the slave program by slave CPU 12 in the respective voice units 10-1 to 10-16.

Figure 6:
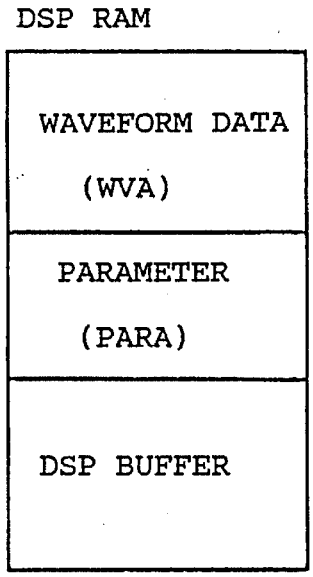
FIG. 6 is a memory map of DSP-RAM shown in FIG. 2.

The DSP 13 includes an input/output interface or I/O 13*a*, an arithmetic logic portion 13*b* composed of various operators, selectors and registers for effecting high speed processing under control of the DSP program to synthesize the element musical tone signals and a program memory 13*c* composed of a number of registers for memorizing the DSP program. The slave RAM 14 has a first memory area for memorizing the slave program and DSP program, a second memory area for memorizing a slave element control data SLV-ELM for each of the element musical tone signals, a third memory area for memorizing an alive flag ALFG representing each operating condition of the voice units and a buffer area adapted as an operation area of the slave CPU 12. As shown in FIG. 6, the DSP-RAM 15 has a first memory area for memorizing a waveform data WVA applied from the master CPU 41 through the input/output port 13*a* of the DSP 13, a second memory area for memorizing a slave parameter PARA formed on a basis of the slave element control data SLV-ELM applied from the master CPU 41 through the slave RAM 14 and a buffer area adapted as an operation area of the DSP 13.

As shown in FIG. 2, the bus controller 20 includes a common address decoder 21 for the voice units 10-1 to 10-16, a selection latch 22 and a halt latch 23, three-state buffers 24-1 to 24-16 corresponding with the voice units 10-1 to 10-18. The address decoder 21 is connected to an address bus 30*b* forming a part of the common data bus 30 to decode an encoded address signal for producing a halt address signal HALTAD, a selection address signal SELAD and a voice unit selection signal VUSEL. The voice unit selection signal VUSEL is applied as a high level "1" to all the addresses allotted to the slave CPU 12, slave RAM 14 and DSP-RAM 15.

The selection latch 22 is connected to a data bus 30*a* forming a part of the common data bus 30 to latch the selection data for selecting the voice units 10-1 to 10-16 and for producing selection signals SEL1-SEL16 based on the latched selection data. The latch control input of selection latch 22 is connected to an AND circuit AND1 which applies a latch control signal to the selection latch 22 when applied with the selection address signal SELAD at a high level "1" and a writing control signal R/W at a low level "0" from a control bus 30*c* forming a part of the common data bus. Similarly, the halt latch 23 is connected to the data bus 30*a* to latch a halt data for temporarily halting each slave CPU 12 of the voice units 10-1 to 10-16 and for applying halt signals HALT1-HALT16 corresponding with the latched halt data to each slave CPU 12 of the voice units 10-1 to 10-16. The halt latch 23 is connected at its input terminal to an AND circuit AND2 which applies a latch control signal to the halt latch 23 when applied with the halt address signal at a high level "1" and the low level writing control signal R/W.

The three-state buffers 24-1 to 24-16 are provided to selectively control signal transmission between the data bus 30*a* and address bus 30*b* or between the control bus 30*c* and slave bus 11. When each output signal of AND circuits AND3 becomes a high level signal "1", an electric signal from the address bus 30*b* is supplied to the respective slave buses 11 under control of the three-state buffers 24-1 to 24-16. When each output signal of AND circuits AND4 becomes a high level signal "1", an electric signal from each of the slave buses 11 is supplied to the data bus 30*a* under control of the three-state buffers 24-1 to 24-16. When each output signal of AND circuits AND 5 becomes a high level signal "1", an electric signal from the data bus 30*a* is supplied to each of the slave buses 11 under control of the three-state buffers 24-1 to 24-16. The AND circuits AND3 each produce a high level signal "1" therefrom when the selection signal SELi(i=1–16), halt signal HALTi(i=1–16) and voice unit selection signal VUSEL each become a high level signal "1". The AND circuits AND 4 each produce a high level signal "1" therefrom when the output signals of AND circuits AND3 and the low level writing control signal R/W each become a high level signal "1". The AND circuits AND5 each produce a high level signal "1" therefrom when each output signal of AND circuits AND3 becomes a high level signal "1" and the writing control signal R/W becomes a low level signal "0".

As shown in FIG. 1, each musical tone signal synthesized at the voice units 10-1 to 10-16 is supplied to an effect-application circuit 61 which is directly applied with a serial effect control data SEREFT from the master CPU 41 through the transmission line 32 to apply a musical effect defined by the effect control data to the digital musical tone signals and to divide the digital musical tone signals into left and right channels for applying them to a digital/analog converter 62. The digital/analog converter 62 converts the digital musical tone signals of the left and right channels into analog signals and applies them to speakers 65, 66 through amplifiers 63, 64.

Hereinafter, operation of the musical tone signal generating apparatus will be described with reference to flow charts shown in FIGS. 7–15. When a power source switch (not shown) of the musical Cone signal generating apparatus is closed, the master CPU 41 is activated at step 100 in FIG. 7 and executes at step 102 an initialization routine shown in FIG. 8. At step 200 of FIG. 8, the master CPU 41 initiates execution of the initialization routine and causes the program to proceed to step 202. At step 202, the master CPU 41 applies a halt data #$FFFF indicated by 16 order to the data bus 30*a* and applies an address signal, indicative of the halt latch 23 to the address bus 30*c*. The master CPU 41 further applies a low level writing control signal R/W to the control bus 30*c*. Thus, the halt data #$FFFF is latched by the halt latch circuit 23. Since the halt data #$FFFF represents the fact that all the 16 bits each are a high level, the halt latch circuit 23 applies halt signals HALT1-HALT16 at a high level "1" to each slave CPU 12 of the voice units 10-1 to 10-16. As a result, each slave CPU 12 of the voice units is halted.

After processing at step 202, the master CPU 41 initializes the internal registers and I/O thereof at step 204 and causes the program to proceed to step 206. At step 206, the master CPU 41 applies the selection data #$FFFF to the data bus 30*a*, the address signal indicative of the selection latch 22 to the address bus 30*b* and the low level writing control signal R/W to the control bus 30*c*. Thus, the selection data #$FFFF is latched by the selection latch 22. Since the selection data #$FFFF represents the fact that all the 16 bits each are a high level, the selection latch 22 produces selection signals SEL1-SEL-16 each at a high level.

When the program proceeds to step 208 after processing at step 206, the master CPU 41 successively applies the slave program and DSP program to the data bus 30*a* from the program ROM 42. Simultaneously, the master CPU 41 successively applies an address signal indicative of an address in the program memory area of the slave RAM 14 to the address bus 30*b* and applies the low level writing control signal R/W to the control bus 30*c*. When applied with the address signal, the address decoder 21 continues to produce a voice unit selection signal VUSEL at a high level "1", and the AND circuits AND3, AND5 continue to apply a high level signal to the control terminals A, C of each of the three-state buffers 24-1 to 24-16. In this instance, the three-state buffers 24-1 to 24-16 act to apply the slave program and DSP program to the respective slave buses 11 from the data bus 30*a* and to apply the address signal and the writing control signal R/W to each of the slave buses 11 respectively from the address bus 30*b* and control bus 30*c*. Thus, the slave program and DSP program are memorized in a predetermined area in each slave RAM 14 of the voice units 10-1 to 10-16.

After processing at step 208, the master CPU 41 applies at step 210 a release data #$0000 to the halt latch 23 in the same manner as at step 202 and ends the execution of the initialization routine at step 212. Since the release data #$0000 represents the fact that all the 16 bits each are "0". the halt latch 23 acts to apply the halt signals HALT1–HALT16 at a low level to each slave CPU 12 of the voice units 10-1 to 10-16. Thus, each slave CPU 12 of the voice units 10-1 to 10-16 is released from its halted condition. After execution of the initialization routine, the master CPU 41 activates a timer housed therein at step 104 shown in FIG. 7 and ceases the progression of the program for a predetermined time at step 106.

Figure 15:
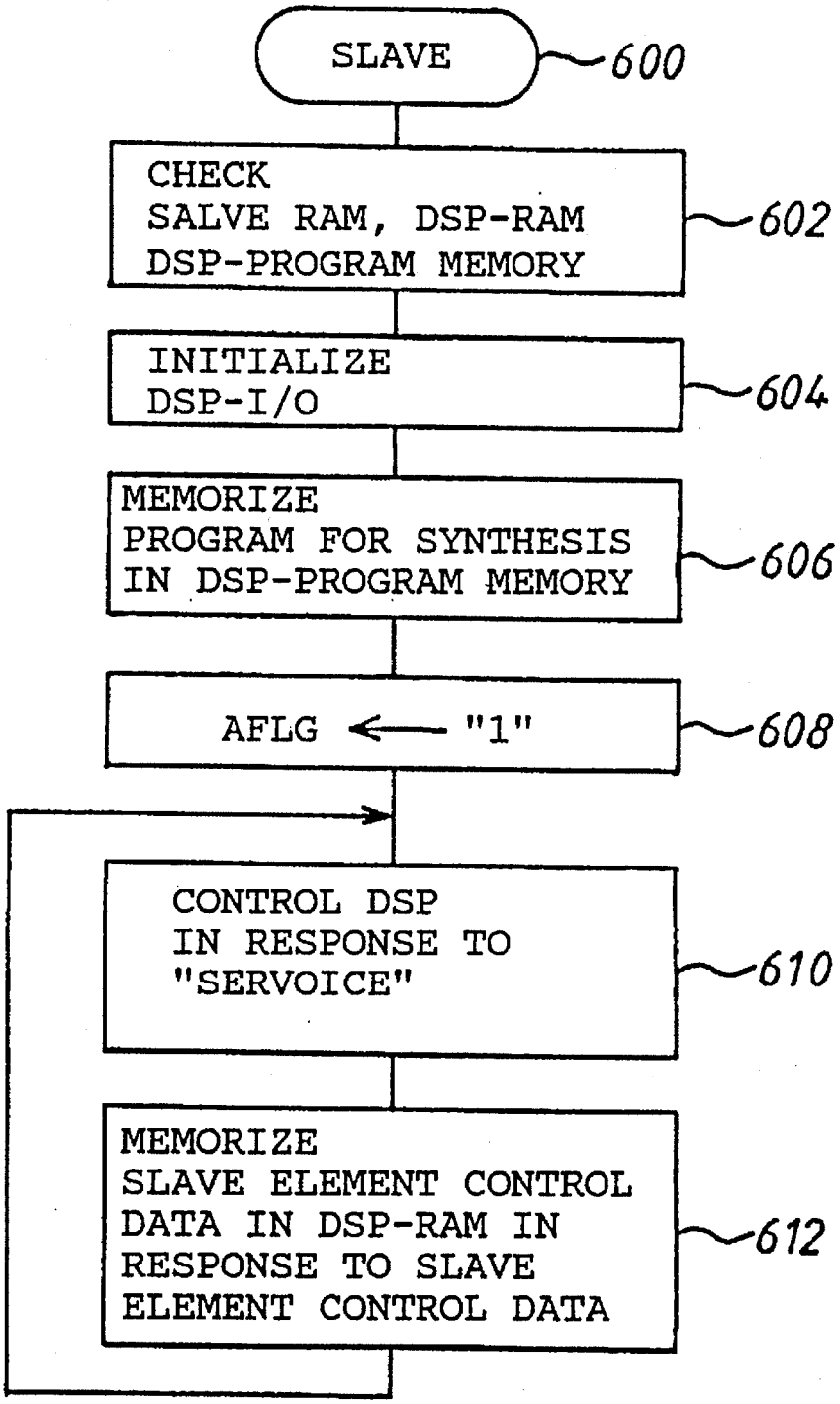
FIG. 15 is a flow chart of a slave program executed by the slave CPU shown in FIG. 2.

When released from its halted condition, each slave CPU 12 of the voice units 10-1 to 10-16 initiates execution of the transmitted slave program at step 600 shown in FIG. 15. When the slave program proceeds to step 602, each slave CPU 12 of the voice units determines whether or not the slave RAM 14, DSP-RAM 15 and program memory 13*c* of DSP 13 each are in a normal condition capable of reading out input data applied thereto and initializes the slave RAM 14. DSP-RAM 15 and program memory 13*c* of DSP 13 for confirming operation of the voice units 10-1 to 10-16. If the answer at step 602 is "Yes", the slave program proceeds to step 604 where each slave CPU 12 of the voice units 10-1 to 10-16 initializes the input/output or I/O device thereof and causes the program to proceed to step 606. At step 606, each slave CPU 12 of the voice units memorize the DSP program into the program memory 13*b* of DSP 13 from the RAM 14. When the DSP program is normally written into the program memory 13*b*, the slave program proceeds to step 608 where each slave CPU 12 of the voice units sets the alive flag AFLG as "1" and initiates to repeatedly execute processing at step 610 and 612. If the processing at step 602 to 606 is failed, the alive flag AFLG may not be set as "1".

Figure 7:
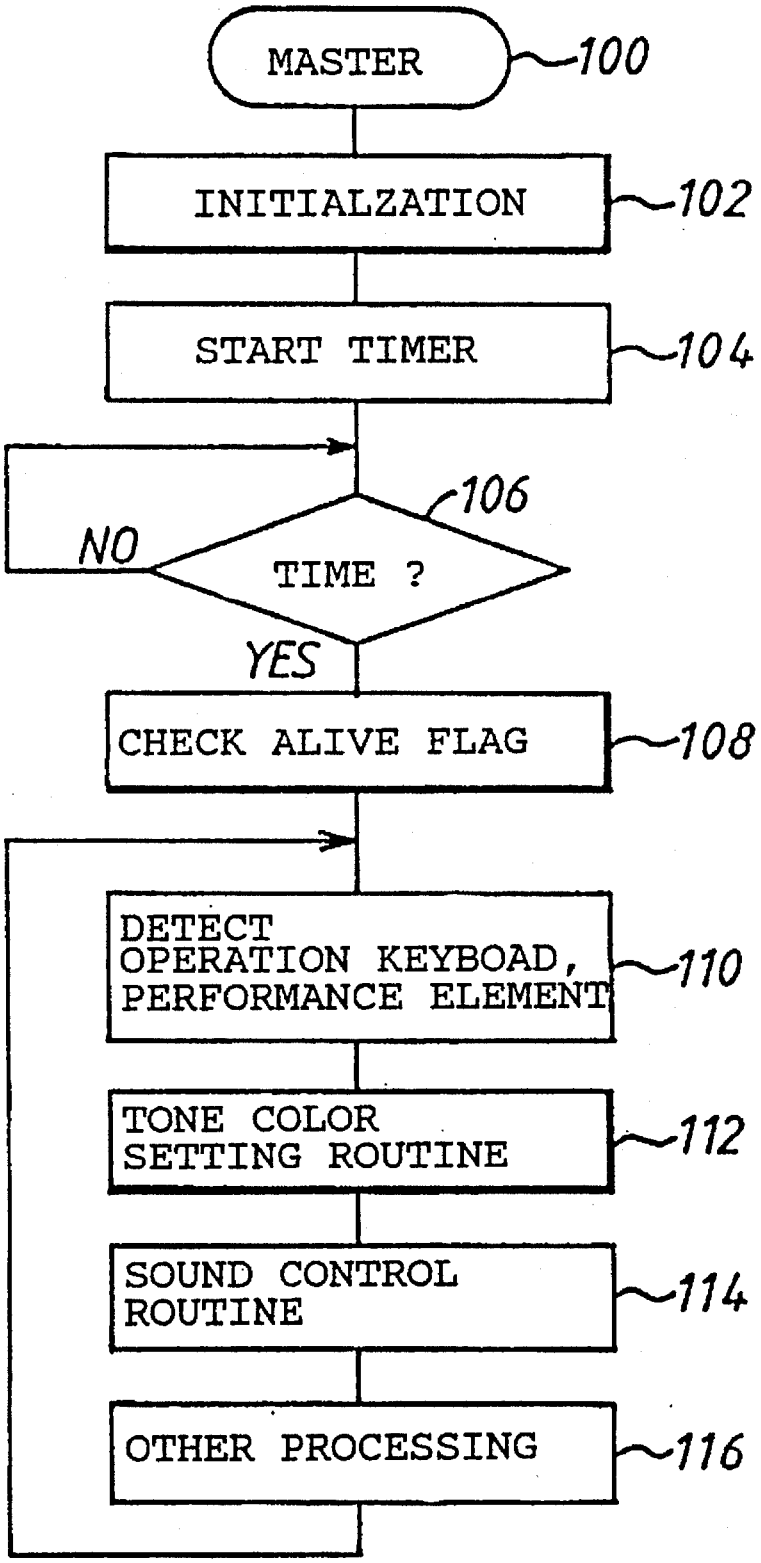
FIG. 7 is a flow chart of a master program executed by the master CPU shown in FIG. 1.
Figure 8:
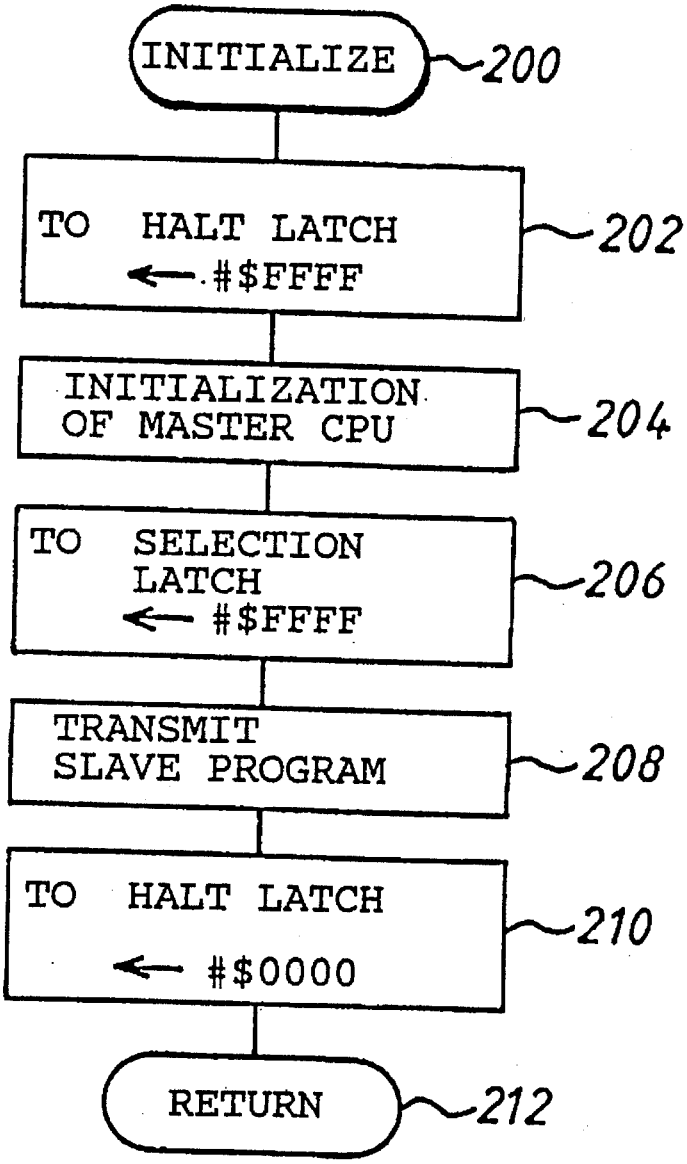
FIG. 8 is a flow chart of an initialization routine shown in FIG. 7.
Figure 9:
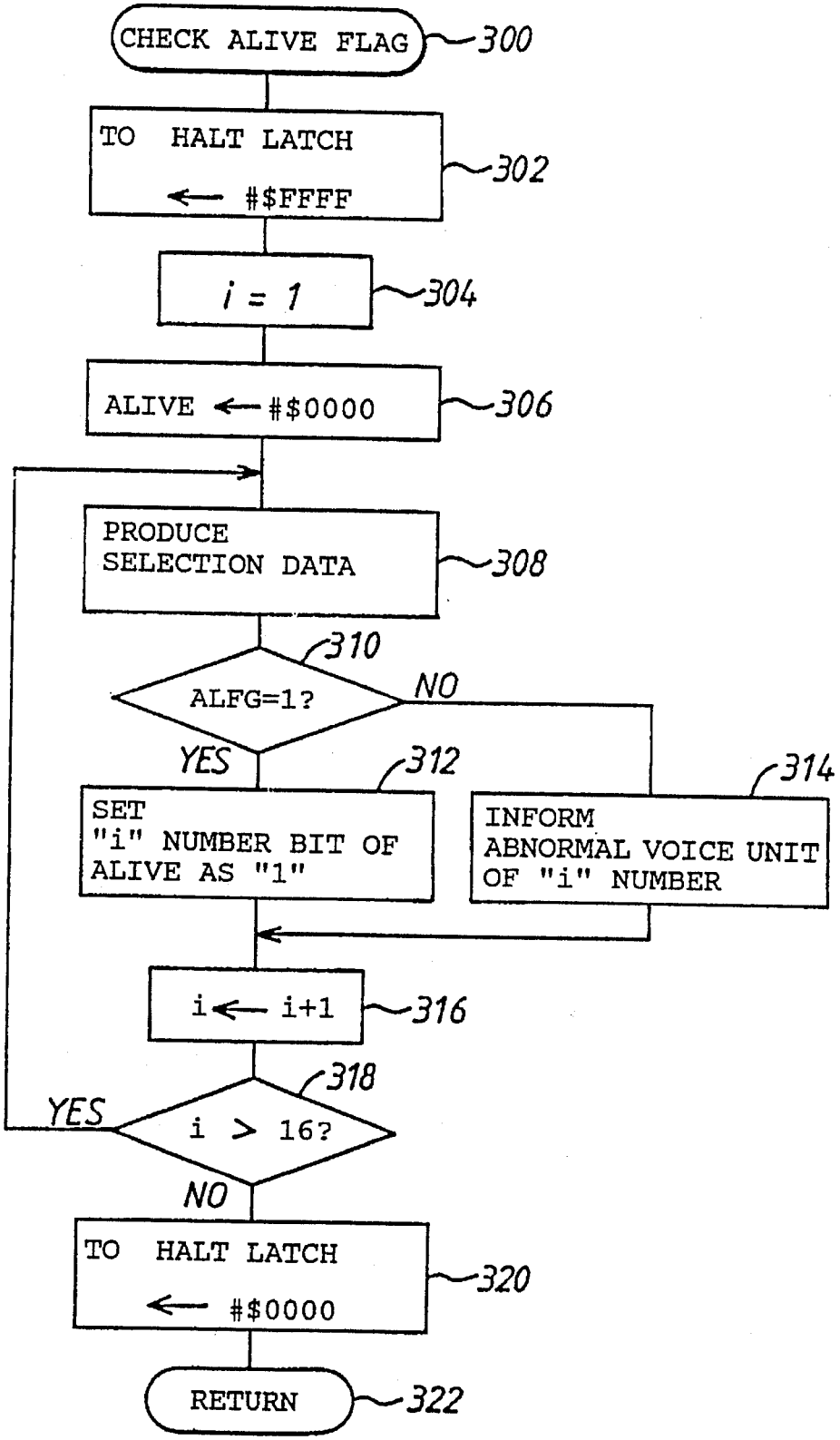
FIG. 9 is a flow chart of an alive flag checking routine shown in FIG. 7.

During execution of the processing at step 602-612 shown in FIG. 15, the master CPU 41 is being conditioned to halt the progression of the program at step 106 shown in FIG. 7. Upon lapse of a time sufficient for confirming the operation of the voice units 10-1 to 10-16, the master CPU 41 determines a "Yes" answer at step 106 and causes the program to proceed to step 108 where the master CPU 41 executes an alive flag checking routine shown in FIG. 9. When the program proceeds to step 300 shown in FIG. 9, the master CPU 41 initiates execution of the alive flag checking routine and causes the program to proceed to step 302. At step 302, the master CPU 41 applies the halt signals HALT1–HALT16 to the halt latch 23 to halt the operation of each slave CPU 12 of the voice units 10-1 to 10-16.

Subsequently, the master CPU 41 sets a variable i as "1" at the following step 304 and sets the alive data ALIVE in the RAM 43 as "#$0000" at step 306. Thereafter, the master CPU 41 repeatedly executes processing at step 308 to 314 by increasing the variable i to "16" at step 316 and 318. At step 308, the master CPU 41 produces a selection data representing only an "1" number bit in the 16 bits as a high level "1" and all the other bits respectively as a low level "0" and applies the selection data to the data bus 30*a*. Simultaneously, the master CPU 41 applies an address signal indicative of the selection latch 22 to the address bus 30*b* and applies a low level writing control signal R/W to the control bus 30*c*. Thus, the selection latch 22 latches the selection data and produces a selection signal SEL1-SEL16 representing only the "i" number bit as the high level "1".

At the following step 310, the master CPU 41 applies an address signal representing a memory address of the alive flag AFLG in the salve RAM 14 to the address bus 30*b* and applies a high level reading control signal R/W to the control bus 30*c*. This causes the address decoder 21 to produce a voice unit selection signal VUSEL at a high level "1". Thus, the three-star buffer 24-1 is applied at its control terminal A with a high level signal "1" from the AND circuit AND3 corresponding with tho voice unit 16-1 selected by the selection signal SEL1-SEL16 and at its control terminal B with a high level signal "1" from the AND circuit AND4 corresponding with the voice unit 16-i. Since the three-state buffer 24-i applies the address signal and high level reading control signal R/W to the slave bus 11, the alive flag AFLG memorized in the slave RAM 14 of the selected voice unit 10-i is read out on the slave bus 11. The alive flag AFLG is applied to the data bus 30*a* from the slave bus 11 under control of the three-state buffer 24-i. In this instance, the master CPU 41 reads out the alive flag AFLG from the data bus 30*a* at step 310 to determine whether the alive flag AFLG is "1" or not. If the voice unit 10-i is in a normal condition, the master CPU 41 determines a "Yes" answer at step 310 and sets the "i" number bit of the alive data ALIVE as "1" at step 312. If the voice unit 10-i is in an abnormal condition, the master CPU 41 determines a "No" answer at step 310, causes the indicator 54 at step 314 to indicate the abnormal condition of the "i" number voice unit 10-i and causes the buzzer 55 to issue an alarm sound. After processing at step 312 or 314, the master CPU 41 causes the program to proceed to step 316. While the processing at step 308-318 is repeatedly executed until the variable "i" becomes "16", the master CPU 41 determines a "Yes" answer at step 318. When the variable "i" becomes "16", the program proceeds to step 320 where the master CPU 41 applies the halt data #$0000 to the halt latch 23 in the same manner as described above to release the halt condition of each slave CPU 12 of all the voice units 10-1 to 10-16. When the slave CPU 12 is released, the master CPU 41 terminates the processing of the alive flag checking routine at step 322 and stares to repeal execution of processing at step 110-116 shown in FIG. 7.

At step 110 of FIG. 7, the master CPU 41 reads out an electric signal indicative of depression or release of each key from the key switch circuit 51 and an electric signal indicative of operation of the performance operation element from the operation switch circuit 52 to detect the keys and operation element newly operated. At the following step 112, the master CPU 41 executes a tone color setting routine shown in FIG. 10. Thus, the master CPU 41 initiates execution of the tone color setting routine at step 400 of FIG. 10 and determines at step 402 whether the tone color selection or the voice selection has been changed or not. If the tone color selection is unchanged, the master CPU 41 determines a "No" answer at step 402 and terminates the execution of the tone color setting routine at step 428. If the tone color selection has been changed, the master CPU 41 determines a "Yes" answer at step 402 and causes the program to proceed to step 404.

At step 404, the master CPU 41 checks the voice parameter VOICE-PMTk (k=1–n) corresponding with the tone color or voice changed in the RAM 43 to determine the number "e" of the element musical tone signals to be synthesized. In this instance, the master CPU 41 counts the number of the element-on data ELMON representing "1" in the voice parameter VOICE-PMTk and determines the counted value as the number "e" of the element musical tone signals. Subsequently, the master CPU 41 applies the halt data HALT1–HALT16 representing all the bits respectively as a high level "1" to the halt latch 23 in the same manner as described above to halt operation of each slave CPU 12 of the voice units 10-1 to 10-16. After the slave CPU 12 is halted, the master CPU 41 executes processing at step 408-414 and causes the program to selectively proceed to step 416-422 in accordance with the number "e" of the element musical tone signals.

Figure 11:
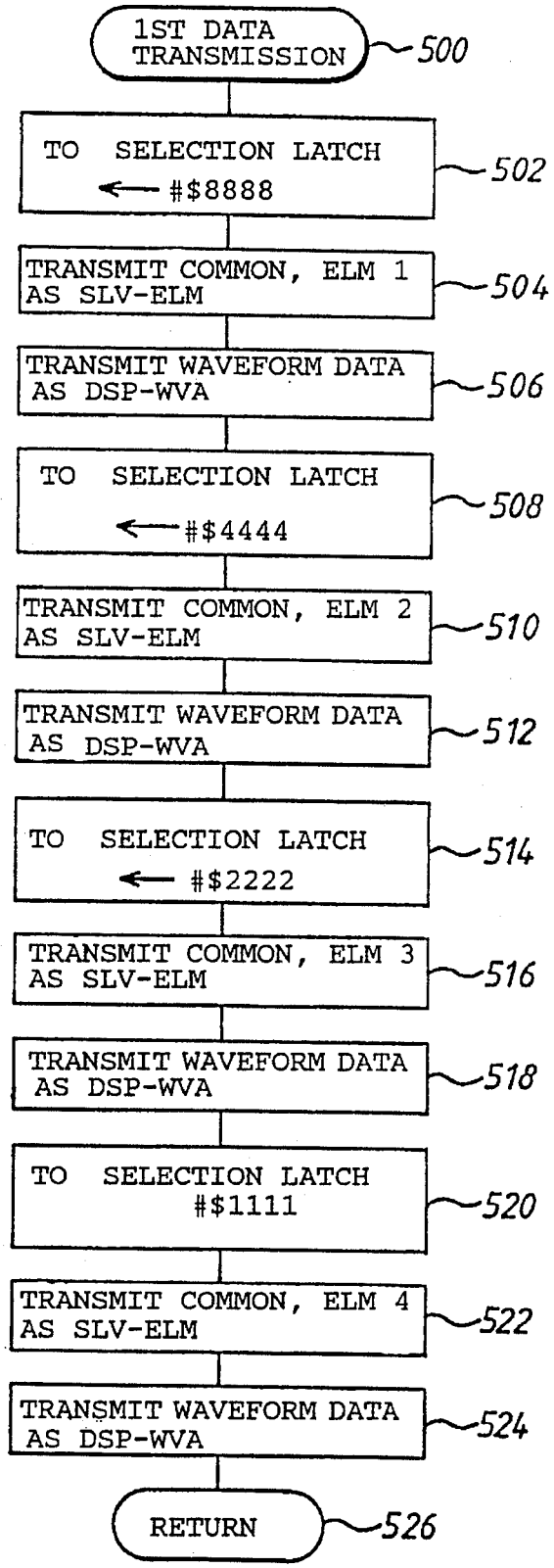
FIG. 11 is a flow chart of a first data transmission routine shown in FIG. 10.

It the number "e" of the element musical tone signals is "4", the master CPU 41 executes a first data transmission routine at step 416 shown in FIG. 11. Thus, the master CPU 41 initiates execution of the first data transmission routine at step 500 and applies at step 502 the selection data #$8888 to the selection latch 22 in the same manner as described above. Since the selection data #$8888 is represented as "1000100010001000", the selection latch 22 produces only the selection signals SEL4, SEL8, SEL12, SEL16 respectively as a high level signal "1". At the following step 504, the master CPU 41 produces a common control data COMMON of the voice parameters VOICE-PMTk corresponding with the selected tone color memorized in the RAM 43 and a control data ELM1 for the first element musical tone signal and applies them to the data bus 30*a*. Simultaneously, the master CPU 41 applies an address signal representing a memory area of a slave element control data SLV-ELM for the slave RAM 14 to the address bus 30*b* and applies the low level writing control Signal R/W to the control bus 80*c*. While being applied with the address signal, the address decoder 21 continues to produce the voice unit selection signal VUSEL at a high level "1" so that the AND circuits AND3, AND5 corresponding with the voice units 10-4, 10-8, 10-12, 10-16 continuously apply a high level signal "1" to the control terminals A, C of the three-state buffers 24-4, 24-8, 24-12, 24-18. Thus, the three-state buffers 24-4, 24-8, 24-12, 24-18 act to apply the control data COMMON, ELM1, address signal, writing control signal R/W to the slave bus 11 respectively from the data bus 80*a*, address bus 80*b* and control bus 80*c*. As a result, the control data COMMON. ELM1 are written into the memory area of the slave element control data SLV-ELM for each slave RAM 14 of the voice units 10-4, 10-8, 10-12, 10-18.

When the program proceeds to step 506, the master CPU 41 applies a waveform data memorized in the waveform ROM 44 for synthesis of the first element musical tone signal to the data bus 30*a*. Simultaneously, the master CPU 41 applies an address signal representing a memory area of the waveform data WVA in the DSP-RAM 13 to the address bus 30*b* and applies a low level writing control signal R/W to the control bus 30*c*. While being applied with the address signal, the address decoder 21 continues to produce the voice unit selection signal VUSEL at a high level "1" so that the AND circuits AND3, AND5 corresponding with the voice units 10-4, 10-8, 10-12, 10-16 continue to apply a high Level signal to the control terminals of each of the three-state buffers 24-4, 24-8. 24-12, 24-16. Thus, the three-state buffers 24-4, 24-8, 24-12, 24-16 continue to apply the waveform data, address signal and writing control signal R/W to the slave bus 11 respectively from the data bus 30*a*, address bus 30*b* and control bus 30*c*. As a result, the waveform data is written into the memory area of each DSP-RAM 15 through the I/O port 13*a* of DSP 13 in the voice units 10-4, 10-8, 10-12, 10-16.

After writing the control data COMMON, ELM1 and waveform data into the voice units 10-4, 10-8, 10-12, 10-16, the master CPU 41 executes processing at step 508-512 in the same manner as that at step 502-506 to write the common control data of the voice parameter VOICE-PMTk corresponding with the selected tone color and control data ELM2 for the second element musical tone signal into each slave RAM 14 of the voice units 10-3, 10-7, 10-11, 10-15 and to write the waveform data for synthesis of the second element musical tone signal into each DSP-RAM 15 of the voice units 10-3, 10-7, 10-11, 10-15. In this instance, the master CPU 41 writes at step 508 a selection data #$4444 represented by "0100010001000100" into the selection latch 22 to designate the voice units 10-3, 10-7, 10-11, 10-15.

After processing at step 508-512, the master CPU 41 executes processing at step 514-518 to write the common control data COMMON of the voice parameter VOICE-PMTk corresponding with the selected tone color and control data ELM2 for the third element musical tone signal into each slave RAM 14 of the voice units 10-2, 10-6, 10-10, 10-14 and to write the waveform data for synthesis of the third element musical tone signal into each DSP-RAM 15 of the voice units 10-2, 10-6, 10-10, 10-14. In this instance, the master CPU 41 writes at step 514 a selection data #$2222 represented by "0010001000100010" into the selection latch 22 to designate the voice units 10-2, 10-6, 10-10, 10-14.

Figure 16:
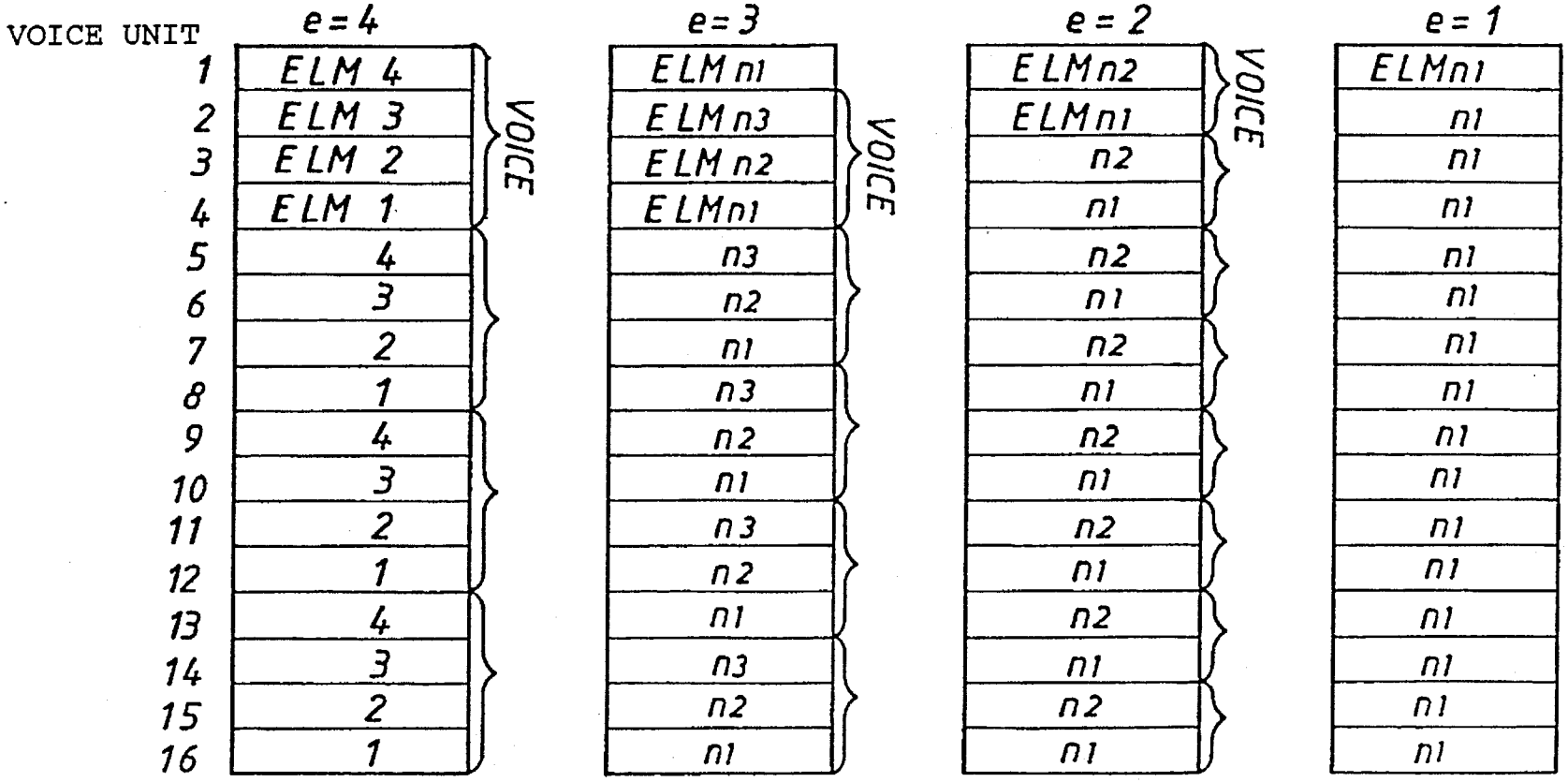
FIG. 16 illustrates allotment conditions of element musical tone signals to the voice units shown in FIG. 1.

After processing at step 514-518, the master CPU 41 executes processing at step 520-524 in the same manner as described above to write the common control data COMMON of the voice parameter VOICE-PMTk corresponding with the selected tone color and control data ELM2 for the fourth element musical tone signal into each slave RAM 14 of the voice units 10-1, 10-5, 10-9, 10-13 and to write the waveform data for synthesis of the fourth element musical tone signal into each DSP-RAM 15 of the voice units 10-1, 10-5, 10-9, 10-13. In this instance, the master CPU 41 writes at step 520 a selection data #$1111 represented by "0001000100010001" into the selection latch 22 to designate the voice units 10-1, 10-5, 10-9, 10-13. As a result of processing at step 502-524, the control data for the first to fourth element musical tone signals with respect to the selected tone color is transmitted to each of the voice units 10-1 to 10-16 as illustrated by a column "e=4" in FIG. 16, and the execution of the first transmission routine is, terminated at step 526.

Figure 10:
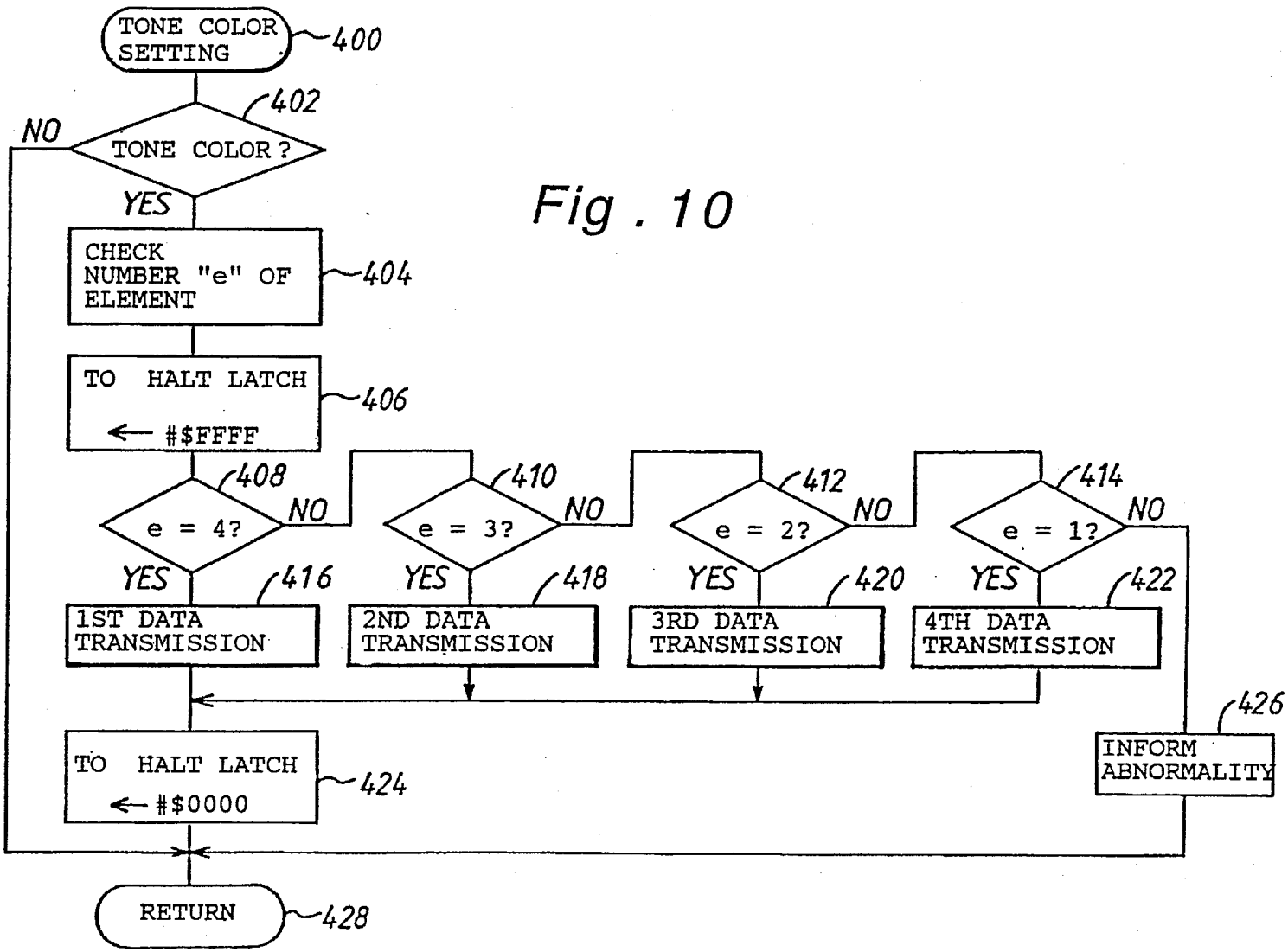
FIG. 10 is a flow chart of a tone color setting routine shown in FIG. 7.
Figure 12:
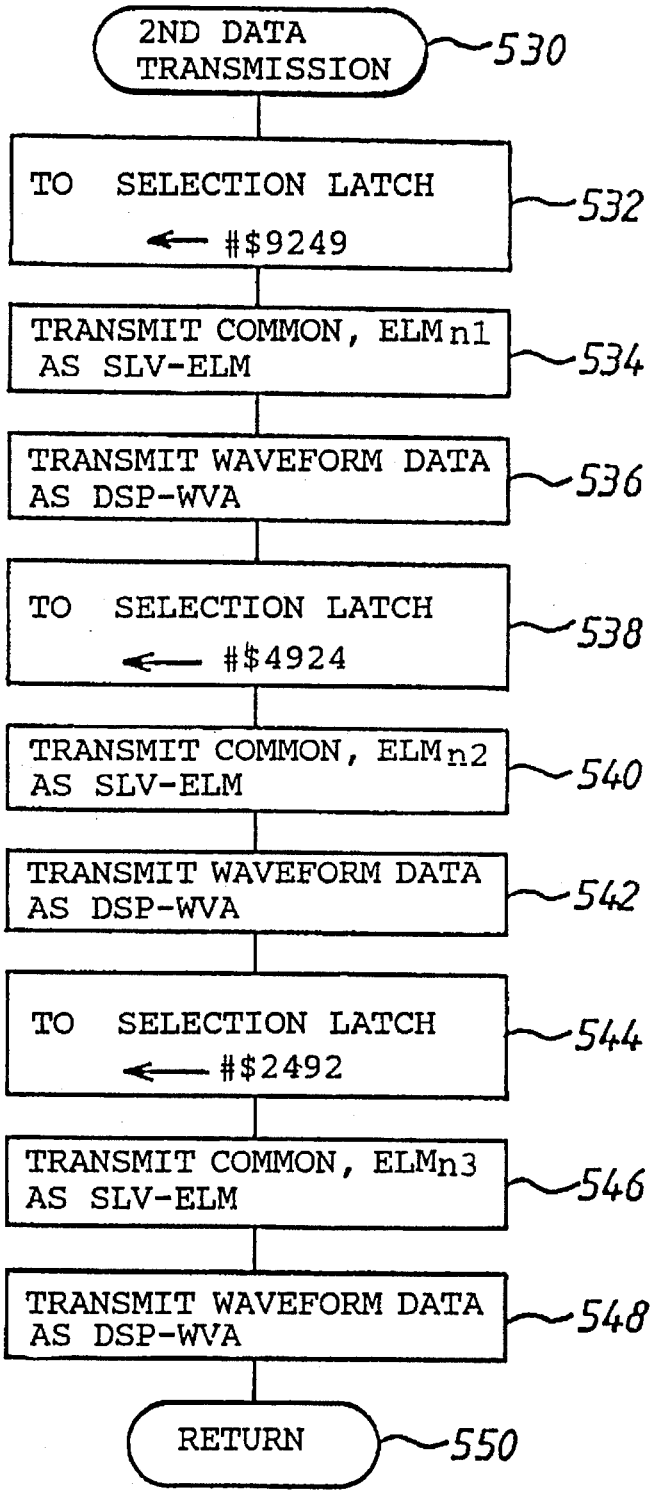
FIG. 12 is a flow chart of a second data transmission routine shown in FIG. 10.
Figure 13:
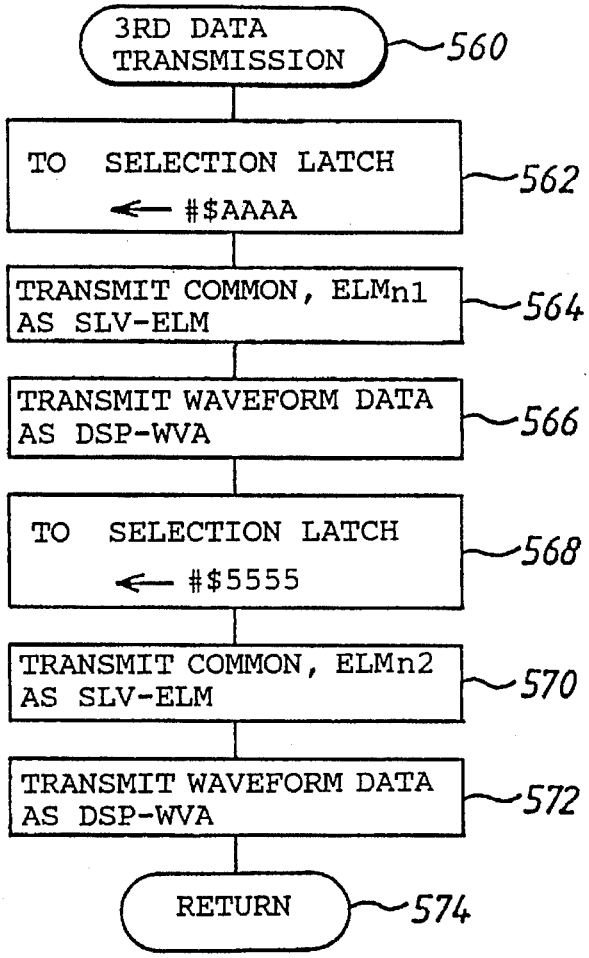
FIG. 13 is a flow chart of a third data transmission routine shown in FIG. 10.
Figure 14:
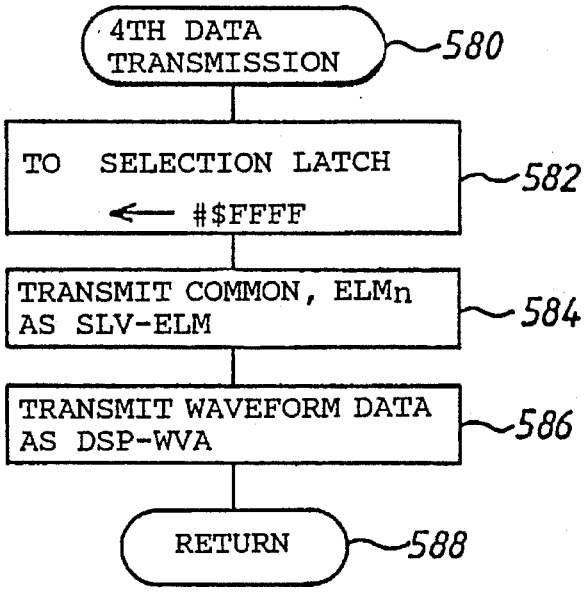
FIG. 14 is a flow chart of a fourth data transmission routine shown in FIG. 10.

If the number "e" of the element musical Cone signals is "3" during execution of the program shown in FIG. 10, the master CPU 41 will execute at step 418 a second transmission routine shown in FIG. 12. In this instance, the master CPU 41 executes processing at step 530-550 of FIG. 12 to transmit the control data for the first to third element musical tone signals with respect to the selected tone color to the voice units 10-1 to 10-16 respectively as illustrated by a column "e=3" in FIG. 16. During execution of the second transmission routine, selection data #$9249, #$4924, #$2492 are represented by "1001001001001001", "0100100100100100", "0010010010010010" at step 532, 538, 544, respectively. At step 534, 540, 546, the common control data COMMON of the selected voice parameter VOICE-PMTk and the control data ELMn1, ELMn2, ELMn3 for the first to third element musical tone signals are transmitted to the voice units 10-1 to 10-16, respectively. At step 536, 542, 548, the waveform data for the first to third element musical tone signals is transmitted to the voice units respectively.

If the number "e" of the element musical tone signals is "2" during execution of the program shown in FIG. 10, the master CPU 41 will execute at step 420 a third transmission routine shown in FIG. 18. In this instance, the master CPU 41 executes processing at step 560-574 of FIG. 13 to transmit the control data for the first and second element musical tone signals with respect to the selected tone color to the voice units 10-1 to 10-16 respectively as illustrated by a column "e=2" in FIG. 16. During execution of the third transmission routine, selection data #$AAAA, #$5555 are represented by "1010101010101010", "0101010101010101" at step 562, 588, respectively. At step 564, 570, the common control data COMMON of the selected voice parameter VOICE-PMTk and the control data ELMn1, ELM2 for the first and second element musical tone signals are transmitted to the voice units 10-1 to 10-16 respectively. At step 566, 572, the waveform data for the first and second element musical tone signals is transmitted to the voice units respectively.

If the number "e" of the element musical tone signals is "1" during execution of the program shown in FIG. 10, the master CPU 41 will execute at step 422 a fourth transmission routine shown in FIG. 74. In this instance, the master CPU 41 executes processing at step 580-588 of FIG. 14 to transmit the control data for the element musical tone signal with respect to the selected tone color to the voice units 10-1 to 10-16 respectively as illustrated by a column "e=1" in FIG. 16. During execution of the fourth transmission routine, a selection data #$FFFF is represented by "1111111111111111" at step 582. At step 584, the common control data of the selected voice parameter VOICE-PMTk and the control data ELMn1 for the element musical tone signal are transmitted to the voice units 10-1 to 10-16 respectively. At step 586, the waveform data for the element musical tone signal is transmitted to the voice units respectively.

After processing at step 416 to 422 of the program shown in FIG. 10, the master CPU 41 releases at step 424 the halt condition of each slave CPU 12 in the voice units 10-1 to 10-16 and terminates the execution of the tone color setting routine at step 428. If the number "e" of the element musical tone signals is "0" during processing at step 404, the master CPU 41 determines a "No" answer at step 408-414 respectively and activates the indicator 54 and buzzer 55 at step 426 to indicate an abnormal setting of the voice parameter and to issue an alarm sound.

When the control data COMMON, ELM1-ELM4 of the element musical tone signals are transmitted as a slave element control data SLV-ELM to the voice units 10-1 to 10-16 by execution of the tone color selling routine, each CPU 12 of the voice units 10-1 to 10-16 executes processing at step 612 of FIG. 15 to write the slave element control data SLV-ELM memorized in RAM 14 and a control data newly produced on a basis of the control data SLV-ELM into each DSP-RAM 15 through each DSP-I/O 18*a*. Thus, the DSP 13 will effect processing at its arithmetic logic portion 13*b* based on the DSP program memorized in the program memory 13*a* to synthesize the element musical tone signals in accordance with the waveform data and the slave element control data SLV-ELM memorized in DSP-RAM 15.

Referring back to the master program shown in FIG. 7, the master CPU 41 executes a sound control routine at step 114. If depression or release of the keys on the keyboard 51 is newly detected by processing at step 110, the master CPU 41 allots at step 114 the newly depressed or released keys to the sound channel or either one of the voice units 10-1 to 10-16 and causes the selection latch 22 to latch a selection data representing the allotted voice unit. Thus, the master CPU 41 applies a pitch data indicative of a tone pitch of the depressed or released keys and a serial voice control data SERVOICE composed of a key-on/off signal indicative of the depressed or released keys to the transmission line 31.

If the input terminal 41*a* of master CPU 41 is applied with a MIDI data during the execution of the sound control routine, the master CPU 41 compares the channel data in the applied MIDI data with a voice MIDI channel data VMCH or an element MIDI channel data VMCH in the voice parameters. If the channel data in the MIDI data is identical with the voice MIDI channel data VMCH, the master CPU 41 executes sound allotment of the MIDI data and causes the selection latch 22 to latch a selection data representing the allotted voice unit. Thus, the master CPU 41 applies a pitch data in the MIDI data and a serial voice control data SERVOICE composed of a key-on/off signal indicative of the depressed or released keys to the transmission line 31. If the channel data in the MIDI data is identical with the element MIDI channel data EMCH, the master CPU 41 allots the MIDI data to one of the voice units 10-1 to 10-16 and causes the selection latch 22 to latch a selection data representing the allotted voice unit. Thus, the master CPU 41 applies a pitch data in the MIDI data and a serial voice control data SERVOICE composed of a key-on/off signal indicative of the depressed or released keys to the transmission line 31.

When the selection data is latched, the corresponding selection latch circuit 22 applies the selection signal SELk (k=1–16) to the slave CPU 12 of the corresponding voice unit. In response to the selection signal SELk, the slave CPU 12 executes processing at step 610 of FIG. 15 to apply the pitch data and a control signal for designating sound of the element musical tone signals to the DSP 13. Thus, the arithmetic logic portion of DSP 13 executes processing of the DSP program memorized in the program memory 13*c* to synthesize the element musical tone signals of a tone pitch represented by the pitch data in accordance with the waveform data and slave element control data SLV-ELM memorized in the RAM 15. When the DSP 13 is applied with a control signal for designating halt of the sound of the element musical tone signals, the DSP 13 halts synthesis of the element musical tone signals after gradually attenuated the element musical tone signals.

If the performance operation element is operated to change the musical tone factors (pitch, tone color, tone volume) of the generated musical tone signals during processing at step 110, the master CPU 41 detects the operation of the performance operation element and causes the selection latch 22 to latch a selection data representing the voice units 10-1 to 10-16 generating the musical tone signals by processing at step 116 of FIG. 7. Thereafter, the master CPU 41 applies a serial voice control data SERVOICE indicative of the operated performance operation element to the transmission line 31. In this instance, the corresponding slave CPU 12 is applied with the serial voice control data SERVOICE to supply a control signal defined by the serial voice control data to the arithmetic logic portion 13*b* of DSP 13 thereby to cause variation of the musical tone factors of the generated element musical tone signals.

The musical tone signals generated from the respective voice units 10-1 to 10-16 as described above are applied to the effect application circuit 61. When the effect control operation element is operated, the master CPU 41 executes processing at step 116 to apply the serial effect control data SEREFT corresponding with the operated element to the effect application circuit 61 through the transmission line 32 and to store the serial effect control data SEREFT therein. Thus, the effect application circuit 61 applies a musical effect defined by the control data SEREFT to the musical tone signals supplied from the voice units 10-1 to 10-16 and divides the digital musical tone signals with the applied musical effect into the left and right channels. The divided digital musical tone signals are converted by the digital/analog converter 62 into analog musical tone signals and supplied to the speakers 65, 66 through the amplifiers 63, 64. The speakers 65, 66 sounds a musical tone corresponding with the analog musical tone signals supplied thereto.

If in the above embodiment the operation element switch of the operation panel 52*a* is operated to change the voice parameters VOICE-PMT1-VOICE-PMTn or the master CPU 41 is applied with the voice parameters VOICE-PMT1-VOICE-PMTn from the magnetic disc 53*a* through the disc driver 53, the master CPU 41 executes processing at step 116 to change the voice parameters memorized in the RAM 43.

As described above in detail, the above embodiment is characterized in that the master CPU 41, program ROM 42, RAM 43 and waveform ROM are connected to the common data bus 30 to which the voice units 10-1 to 10-18 each are connected through the bus controller 20 and that the voice units 10-1 to 10-16 each include the slave CPU 12, the DSP 13 composed of the arithmetic logic portion lab and program memory 13*a*, the slave RAM 14 and the DSP-RAM 15. Under control of the master CPU 41 in operation, the control program to be executed by the slave CPU 12 is transmitted to the slave RAM 14 from the program ROM 42, the DSP program for synthesis of the musical tone signals to be defined as algorithm is transmitted to the program memory 13*c* of DSP 13 from the program ROM 42 through the slave RAM 14, the waveform data is transmitted to the DSP-RAM 15 from the waveform ROM 44, and the voice parameters VOICE-PMT1-VOICE-PMTn are transmitted to the slave RAM 14 and DSP-RAM 15. Thus, under control of the master CPU 41, each slave CPU 12 of the voice units controls the DSP 13 to designate start or halt of synthesis of the musical tone signals, and the arithmetic logic portion 13*b* of DSP 13 is operated to synthesize the musical tone signals defined by the waveform data WVA and slave element control data SLV-ELM on a basis of algorithm according to the DSP program memorized in the program memory 13*c*.

In the above embodiment, a primary processing portion is composed of the master CPU 41, program ROM 42, RAM 43 and waveform ROM 44, which acts to apply the DSP program for synthesis of the element musical tone signals, the voice parameters VOICE-FMT1-VOICE-PMTn (slave element control data SLV-ELM) and the waveform data to the plural voice units 10-1 to 10-16 through the common data bus 30. In the voice units 10-1 to 10-16, an ancillary memory means is composed of the program memory 13*c* of DSP 18, slave RAM 14 and DSP-RAM 15, which acts to memorize the slave program, DSP program, slave element control data SLV-ELM and waveform data WVA, and a synthesizing means is composed of the arithmetic logic portion 13*b* of DSP and a portion of the DSP-RAM 15, which executes the DSP program under control of the slave CPU 12 to synthesize the element musical tone signals defined by the slave element control data SLV-ELM and waveform data WVA.

Although in the above embodiment, respective control data ELM1-ELM4 of the voice parameters VOICE-PMT1-VOICE-PTMn are distributed to the voice units 10-1 to 10-16 to memorize the common DSP program for synthesis of the element musical tone signals into the voice units 10-1 to 10-16, various kinds of DSP programs for synthesis of the element musical tone signals may be scored in the program ROM 42 to memorize different DSP programs into the program memories 13*c* of the voice units 10-1 to 10-16 respectively to effect different synthesis of the clement musical tone signals at each DSP 13 of the voice units. Alternatively, the program ROM 42 and waveform ROM 44 each may be replaced with a random access memory or RAM to modify the DSP program and waveform data in response to operation of the operation clement or an input applied from the magnetic disc 53 through the disc driver 53.

Although in the above embodiment, the master CPU 41 is designed to produce the halt signals HALT1-HALT16 for temporarily halting the operation of the slave CPU 12 prior to transmission of the control data to the voice units 10-1 to 10-16, the common data bus 30, bus controller 20 and slave bus 11 may be released in a short period of time at each execution cycle of the slave CPU 12. Although in the above embodiment, an abnormal condition of the voice units 10-1 to 10-16 is detected and informed of the user, operation of the voice unit in an abnormal condition may be prohibited by detection of "0" in the alive data set by processing at step 308-318 of FIG. 9. In this instance, allotment of the depressed key and the applied MIDI data to the abnormal voice unit is prohibited to avoid only synthesis of the musical tone signals in the abnormal voice unit. Although in the above embodiment the present invention has been adapted to an electronic musical instrument of the keyboard type, the present invention may be adapted to a multimedia computer system wherein a plurality of voice units are connected to an expanded bus of a personal computer, a work station and the like.

What is claimed is:

1. A musical tone generating apparatus having a primary processing portion connected to a common data bus for applying to said common data bus a control program for controlling musical tone signal synthesis and control data defining musical tone signals to be synthesized, said apparatus comprising:

a plurality of common voice units connected to said common data bus, said plurality of voice units each including:

ancillary memory means for receiving and storing the control program and control data applied from said common data bus, and ancillary processing means, operatively coupled with said ancillary memory means, for executing the control program for synthesis of the musical tone signals defined by the control data;

selecting means for selecting at least two of said plurality of common voice units; and data transmission means for simultaneously transmitting the control program and control data to said ancillary memory means of each of said selected voice units from said common data bus under control of said primary processing portion.

2. A musical tone signal generating apparatus as claimed in claim 1, wherein said primary processing portion includes an operation element for selecting a tone color of a musical tone to be generated, memory means for memorizing a plurality of voice parameters for synthesis of the element musical tone signals and means for checking the voice parameter corresponding with the selected tone color and for applying the checked voice parameter to said common data bus, and wherein said data transmission means includes means for selectively transmitting the checked voice parameter and the control program and control data to said ancillary memory means of each of said voice units in accordance with the selected tone color.

3. A musical tone signal generating apparatus as claimed in claim 2, wherein the voice parameters each includes a common control data for the element musical tone signals and a control data for each of the element musical tone signals.

4. A musical tone signal generating apparatus as claimed in claim 1, wherein said primary processing portion includes an operation element for selecting a tone color of a musical tone to be generated, memory means for memorizing a plurality of voice parameters for synthesis of the element musical tone signals, means for checking the voice parameter corresponding with the selected tone color for determining the number of the element musical tone signals based on the checked voice parameter and means for applying the checked voice parameter to said common data bus, and wherein said data transmission means includes means for selectively transmitting the checked voice parameter and the control program and control data to said ancillary memory means of each of said voice units in accordance with the number of the element musical tone signals.

5. A musical tone signal generating apparatus as claimed in claim 1, wherein said primary processing portion includes an operation element for selecting a tone color of a musical tone to be generated, first memory means for memorizing a plurality of voice parameters for synthesis of the element musical tone signals, second memory means for memorizing a plurality of waveform data for synthesis of the element musical tone signals, means for checking the voice parameter corresponding with the selected tone color and for applying the checked voice parameter to said common data bus and means for checking, the waveform data corresponding with the selected tone color and for applying the checked waveform data to said common data bus and wherein said data transmission means includes means for selectively transmitting the checked voice parameter and waveform data and the control program and control data to said ancillary memory means of each of said voice units in accordance with the selected tone color.

* * * * *